US005387333A

United States Patent [19]

Tamaki

[11] Patent Number: 5,387,333

[45] Date of Patent: Feb. 7, 1995

[54] PROCESS FOR PRODUCING OPTICALLY ISOTROPIC PITCH

[75] Inventor: Toshio Tamaki, Ibaraki, Japan

[73] Assignee: Petoca Ltd., Tokyo, Japan

[21] Appl. No.: 857,613

[22] Filed: Mar. 25, 1992

[30] Foreign Application Priority Data

Apr. 4, 1991 [JP] Japan ..... 3-097922

[51] Int. Cl.[6] ..... C10L 3/04

[52] U.S. Cl. ..... 208/44; 208/3; 208/6; 208/39

[58] Field of Search ..... 208/4, 3, 6, 44

[56] References Cited

U.S. PATENT DOCUMENTS

| | | | |
|---|---|---|---|
| 3,350,295 | 10/1967 | Hamner et al. | 208/4 |
| 3,480,277 | 1/1970 | Fauber | 208/4 |
| 3,725,240 | 4/1973 | Baum | 208/4 |
| 3,909,389 | 9/1975 | Ruckel et al. | 208/4 |
| 4,096,056 | 6/1978 | Haywood et al. | 208/4 |
| 4,424,107 | 1/1984 | Carlos | 208/4 |
| 4,474,617 | 10/1984 | Uemura et al. | 208/4 |
| 4,883,581 | 11/1989 | Dickakian | 208/4 |
| 4,892,641 | 1/1990 | Fu et al. | 208/4 |
| 4,892,642 | 1/1990 | Romine et al. | 208/4 |
| 4,904,371 | 2/1990 | Kalback | 208/4 |
| 4,971,679 | 11/1990 | Lewis et al. | 208/4 |
| 4,975,176 | 12/1990 | Begliardi et al. | 208/4 |

FOREIGN PATENT DOCUMENTS

| | | | |
|---|---|---|---|
| 0087749 | 9/1983 | European Pat. Off. | C10C 3/00 |
| 61-28020 | 2/1986 | Japan | D01F 9/14 |
| 63-156886 | 6/1988 | Japan | C10C 3/02 |
| 63-156887 | 6/1988 | Japan | C10C 3/02 |
| 2115437A | 9/1983 | United Kingdom | C10C 3/02 |

OTHER PUBLICATIONS

Derwent Abstract of Japanese Patent Publication Sho 63-156886 Jun. 29, 1988.

Derwent Abstract of Japanese Patent Publication Sho 61-289134.

Patent Abstracts of Japan, vol. 10, No. 178: Japanese Patent Appln. 61-28020.

*Primary Examiner*—Helane Myers

*Attorney, Agent, or Firm*—Armstrong, Westerman, Hattori, McLeland & Naughton

[57] ABSTRACT

An optically isotropic pitch can be obtained by a two-stage heat-treatment which combines a heat treatment with air-blowing under normal pressure with a heat treatment with air-blowing under a reduced pressure. Such a pitch is suitable for using as a raw material for producing carbon fibers or activated fibers.

3 Claims, No Drawings

PROCESS FOR PRODUCING OPTICALLY ISOTROPIC PITCH

BACKGROUND OF THE INVENTION

1. Field of the Invention

The present invention relates to an optically isotropic pitch suitable as a raw material for carbon fibers or activated carbon fibers and to a process for producing the same.

More specifically, the invention relates to an optically isotropic pitch suitable as a raw material for carbon fibers or activated carbon fibers which has good spinning ability and has no fear of fusion of fibers during the course of the infusibilization stage, and to a process for producing said optically isotropic pitch by subjecting a pitch (including a heavy oil) to a two-stage heat-treatment.

Furthermore, the invention is to provide an optically isotropic pitch having substantially no anisotropic component and having a low QI (quinoline insoluble) content as the raw material for carbon fibers or activated carbon fibers.

2. Related Art

An optically isotropic pitch as a raw material for carbon fibers requires to contain no primary quinoline insolubles (primary QI components), which are said to hinder the spinning due to their infusibility and insolubility, and to have a high softening point in order to carry out the infusibilization treatment after the spinning smoothly.

Consequently, up to now, a pitch having a high softening point is obtained by removing primary QI components, etc. from a pitch or a heavy oil by means of filtration, etc., and then distilling it or heat-treating it under the conditions where primary QI components and optically anisotropic components are not formed.

However, the softening point of the heat-treated pitch obtained by these methods has not yet been sufficient for smoothly carrying out the spinning of fibers.

Yet, there is a technique where a heavy oil or pitch having the primary QI components removed is heat-treated while blowing therein a gas containing oxygen, etc. (hereinafter referred to as "air-blowing"), whereby a pitch having a relatively high softening point and possessing good properties in terms of spinning pitch (Japanese Patent Laid-Open Sho 61-28020).

In spite of possessing a high softening point, however, it is difficult for the pitch obtained in this manner to suppress the formation of optical anisotropic components, and because of the high content of low boiling point component, there is a likelihood of some kind of trouble in the course of the stage for spinning carbon fibers, the fusion in the course of infusibilization stage, and the low carbonization yield after the sintering stage.

However, it is difficult to be converted into a high softening point in any pitch obtained by the prior art's process without forming any optically anisotropic component. Accordingly, since the pitch has a low softening point and contains large amounts of light fractions having a low boiling point, the fusion of the fibers is brought about in the course of infusibilization at a high heat-up rate.

Moreover, because of large amounts of light components, the pitch possesses the disadvantage of poor spinning characteristics due to the stain of the nozzle, etc.

In order to improve this, a technique where a heavy oil or a pitch having the primary QI components removed is heat-treated while conducting the air-blowing under a reduced pressure to obtain an optically isotropic pitch (Japanese Patent Laid-Open Sho 63-156886), and a technique where an optically isotropic pitch is obtained in a similar process by using a high viscosity reactor capable of being continuously maintained under a reduced pressure (Japanese Patent Laid-Open Sho 63-156887) have been developed, but both techniques have a problem in that the load of the treatment under a reduced pressure is high, the yield of the resulting optically isotropic pitch is low, the cross-linked bonding of the pitch by air-blowing does not proceed, and optically anisotropic components tend to be formed.

SUMMARY OF THE INVENTION

The inventors conducted various studies about the above-described problems. As a result, it has been found that a specific two-stage heat treatment combining a heat treatment with air-blowing under normal pressure with a heat treatment with air-blowing under a reduced pressure enables the production of an optically isotropic pitch suitable as a raw material for carbon fibers or activated carbon fibers containing substantially no optically anisotropic component and having a low QI content, thereby achieving the present invention.

That is, the present invention is (1) a process for producing a pitch for a raw material for carbon fibers or activated carbon fibers which comprises:

(a) a first heat-treatment stage for heat-treating a pitch (including a heavy oil) at a constant temperature while blowing therein an oxygen-containing gas, and stopping said heat treatment just before optically anisotropic components are formed, to obtain an intermediate optically isotropic pitch having a low QI content, and (b) a second heat-treatment stage for heat-treating the intermediate pitch under a reduced pressure at a constant temperature while blowing therein an oxygen-containing gas to obtain an optically isotropic pitch having a high softening point;

(2) the process wherein the first heat-treatment stage (a) is carried out at normal pressure or a low pressure up to 0.3 kg/cm$^2$.G (29,412 Pa), at 300 to 370° C. for 5 to 12 hours while blowing therein an oxygen-containing gas, and the second heat treatment stage (b) is carried out at a reduced pressure of not more than 100 mmHg (13,330 Pa) at 300 to 370° C. for 10 minutes to 3 hours while blowing therein an oxygen-containing gas;

(3) an optically isotropic pitch obtained in the process mentioned under (1), which has good spinning ability, has no fear of fusion of fibers during the course of the infusibilization stage, is suitable for a raw material for carbon fibers or activated carbon fibers, contains substantially no optically anisotropic component, has QI contents as low as about 0 to 25%, and has a high softening point ranging from 260 to 300° C.

In specific embodiments, the invention also provides: a process for producing an optically isotropic pitch type activated carbon fiber comprising (i) a stage for melt-spinning the isotropic pitch mentioned under (3) to obtain a pitch fiber, (ii) a stage for infusibilizing said pitch fiber, and (iii) a subsequent stage for subjecting said infusibilized pitch fiber to an activation treatment or an activation treatment together with a slight carbonization treatment; and a process for producing an optically isotropic pitch type carbon fiber comprising (i) a stage for melt-spinning the isotropic pitch mentioned under (3) to obtain a pitch fiber, (ii) a stage for infusibilizing said pitch fiber, and (iii) a subsequent stage for subjecting said infusibilized pitch fiber to a carbonization treatment, and if necessary, to a graphitization treatment. In specific embodiments of these processes mentioned, said infusibilization stage (ii) is carried out at a high heat-up rate of 6°–13° C./min. up to a temperature of 200°–400° C.

DETAILED DESCRIPTION

The present invention will now be described in detail.

The pitch (heavy oil) which can be used for producing pitch as raw material for carbon fibers or activated carbon fibers is not restricted as long as it provides a pitch having an optical isotropy and a high softening point by heat treatment with air-blowing, and include, for example, those which are prepared from crude oil distillation residues, naphtha cracking residues, ethylene bottom oil, coal liquefied oil, coal tars, etc. via treatment stages such as filtration, distillation, hydrogenation, and catalytic cracking.

From the viewpoints of reactivity with oxygen, a high softening point, and the like, petroleum-based catalytic cracking heavy oils are preferably used.

In the present invention, the use of a specific two-stage heat treatment combining heat treatment (a) under normal pressure while air-blowing with heat treatment (b) under a reduced pressure while air-blowing when the pitch is heat-treated, is of importance.

Specifically, in the case where heat treatment (a) under normal pressure with air-blowing, which is also a prior art, is applied alone, even if an optically isotropic pitch having a high softening point can be obtained, the formation of optically anisotropic components is accompanied and the content of low boiling point components is high. Accordingly, some trouble in the course of spinning stage and fusion in the course of the infusibilization stage are frequently brought about; thus, the carbonization yield after the sintering treatment becomes low.

Similarly, the single application of heat treatment (b) under a reduced pressure with air-blowing is disadvantageous in that the load of the treatment under a reduced pressure is too high, the yield of the resulting optically isotropic pitch is low, the crosslinked binding of the pitch by air blowing does not proceed, and optically anisotropic components are apt to be formed.

When the above-described two-stage heat treatment is carried out, the control of the time for which heat treatment stage (b) is carried out subsequent to heat treatment stage (a) is important. The heat treatment in stage (a) must be stopped just before the generation of the optically anisotropic components and shifted to the heat treatment in stage (b).

To be concrete, the time at which optically anisotropic components are generated is previously confirmed, for example, by sampling inspection, and heat treatment stage (a) may be batchwisely or continuously (automatically) shifted into heat-treatment stage (b) immediately before the generation of the optically anisotropic components.

The advantage of the reduced pressure is diluted if shift into heat treatment stage (b) is after the optically anisotropic components have been significantly generated.

As the apparatus for carrying out such a two-stage heat treatment, which is not specifically restricted as long as it is an extruder equipped with a vent, for example, a pelletizer for producing molded plastic particles, a mixer, and a kneader, as well as a self-cleaning type extruder possessing a means for deaerating and removing various side-products produced from polycondensation can be mentioned.

As a concrete example of an extruder used in the heat treatment of stage (b) according to the present invention, a horizontal type one is generally employed. As this type, an extruder having a construction with a means for stirring, such as a screw, being provided on its body in order to carry out mixing, kneading or polycondensation of plastics homogeneously with a nozzle for blowing air and a nozzle for reducing pressure and deaeration being provided at its appropriate portion (if necessary, a suction means, such as a vacuum pump may be connected) can be mentioned.

Amongst the extruders mentioned above, that which is provided with a nozzle for blowing air and a nozzle for reducing pressure and deaeration is suitable for continuous treatment of both stages (a) and (b). However, the heat treatments of both stages may also be carried out batchwisely. In this case, the heat treatment of stage (a) is carried out in an extruder provided with only a nozzle for blowing air, and the heat treatment of stage (b) is then carried out in an extruder provided with both nozzles mentioned above.

The blowing gas used in both heat treatments mentioned above is required to contain oxygen. If an inert gas, such as nitrogen, is blown, an optically isotropic characteristics are difficult to be maintained and, thus, undesirably an optically anisotropic structure is frequently grown. Particularly, in the heat treatment of stage (b), if the treatment under a reduced pressure is carried out in an inert gas atmosphere, although the conversion of the pitch into one with a high softening point proceeds, optically anisotropic components are formed, whereby it becomes difficult to be spun.

As examples of oxygen-containing gases, air, oxygen-enriched gases, etc. can be mentioned, with air being preferable in terms of its easy obtainability.

The amount of oxygen used is generally 0.2 to 5 NL/min., preferably 0.5 to 2 NL/min., per kg of pitch. In the case of air, the amount is about 4 times that of oxygen.

The first heat treatment stage (a) is usually a heat treatment with air-blowing. Though the conditions are not specially restricted, it is possible to apply a heat treatment at a pressure from normal pressure to a low pressure of about 0.3 kg/cm$^2$.G (29,412 Pa) at 300°–370° C. for 5 to 12 hours while blowing air.

This heat treatment gives an intermediate optically isotropic pitch which has been polymerized and crosslinked to some extent, and whose softening points are relatively enhanced.

The intermediate optically isotropic pitch obtained in the first heat treatment (a) is an optically isotropic pitch having a low QI content ranging from 0 to 15% and a softening point of 230°–270° C., and hardly containing optically anisotropic components.

For the second heat treatment stage (b), specifically, a heat treatment can be applied at a reduced pressure of not more than 100 mmHg (13,330 Pa), preferably from 5 to 30 mmHg (667 to 4,000 Pa), at 300°–370° C. for 10 minutes to 3 hours, preferably 20 minutes to 1 hour, while blowing air into the intermediate optically isotropic pitch obtained from the first heat treatment (a).

In this case, if the pressure exceeds 100 mmHg (13,330 Pa), the merit of the pressure reduction is decreased and, thus, the temperature of the heat treatment must be considerably increased. Conversely, if the pressure is reduced too much to a pressure not more than 100 mmHg (13,330 Pa), not only volatile components but also the isotropic components which are effective components, are undesirably withdrawn. As a rule, it is preferred to carry out the heat treatment at a reduced pressure of 5 to 30 mmHg (667 to 4,000 Pa).

Although the temperature of the heat treatment varies depending upon the degree of the pressure reduction, it is desirably in the range of 300° to 370° C. as a rule. In this case, if the temperature is less than 300° C., it is difficult to sufficiently undergo crosslinking and polymerization of the intermediate optically isotropic pitch obtained in the first heat treatment (a). Conversely, if the temperature exceeds 370° C., it is difficult to control the temperature, the softening point becomes unduly high and, at the same time, optically anisotropic components are disadvantageously formed.

In the present invention, since second heat treatment (b) is carried out, light components contained in the optically isotropic pitch can be efficiently removed (e.g. cut by approximately 10%), the formation of optically anisotropic components can be suppressed as much as possible and, at the same time, the polymerization and crosslinking by air-blowing can take place smoothly, resulting in an optically isotropic pitch having a high softening point.

The optically isotropic pitch obtained by the process according to the present invention contains substantially no optically anisotropic components, has a low QI content ranging from about 0 to 25%, preferably not more than 5%, and has a high softening point in the range of about 260° to 300° C. (determined by Mettler method). It has good spinning characteristics, and there is no fear of fusion bonding of fibers during the course of infusibilization; thus, it is suitable for the pitch to be used as a raw material of carbon fiber or activated carbon fiber.

In this case, if the QI content exceeds 25%, although the infusibilization treatment becomes relatively easy, the spinning characteristics change for the worse due to the coexistence of macromolecular substances. Also, it is desirable that the QI content is zero, i.e., substantially no QI component is contained, but it is necessary to strictly control the heat treatment stage in this case. In practice, the content may be at a level where it is as low as possible, for example, the QI components are preferably regulated to a content of not more than 5%.

In such a case, the QI contents can be lowered by appropriately removing the QI components either after the first heat treatment (a) or the second heat treatment (b) by means of a filter, etc.

Moreover, in the case where the softening point of the optically isotropic pitch obtained in the process according to the present invention is less than 260° C., whereas the formation of the anisotropic components is small, it is difficult to obtain a fiber material having a high strength and to carry out the infusibilization smoothly. In the case where the softening point exceeds 300° C., the viscosity becomes too high to carry out spinning and, moreover, optically anisotropic components tends to coexist.

The confirmation of optically anisotropic components is conducted by visually examining the pitch with a polarization microscope.

The optically isotropic pitch obtained in the process according to the present invention is available as a pitch for producing carbon fibers or activated carbon fibers.

A process for producing carbon fibers or activated carbon fibers using the above-described optically isotropic pitch as a raw material will now be described.

In general, according to the conventional process, the above-described optically isotropic pitch is (1) spun into pitch fibers, (2) said pitch fibers are infusibilized to give infusibilized fibers, and either (3) they are then carbonized and, if necessary, graphitized to produce carbon fibers, or alternatively (4) they are then slightly carbonized followed by activation treatment, or they are directly activated to produce activated carbon fibers:

(1) Production of Pitch Fibers

Though a process for producing pitch fibers is not specifically restricted, generally, any appropriate melt spinning such as melt-blowing, centrifugal spinning, or melt-extrusion may be applied. Melt blowing is preferable in terms of maintaining uniformity of the spun fibers in the state of nonwoven fabric.

For example, spinning by melt blowing may usually be carried out by spinning the fibers from spinning pores provided in a slit or a nozzle from which a gas is spouted at a high speed under the spinning conditions of a spinning pack temperature ranging from 290° to 360° C., a gas temperature ranging from 310° to 380° C., and a spouting rate ranging from 100 to 340 m/sec.

(2) Production of Infusibilized Fibers

A process for producing infusibilized fibers per se can be carried out according to a conventional process.

Generally, it is carried out by heat-treating the fibers at a heat-up rate of 3°–13° C./min., preferably 6°–13° C./min., at a temperature of 200°–400° C., preferably 260°–360° C.

In the case where the heat-up rate in the course of the infusibilization is less than 3° C./min, the purpose for which the present invention is applied is diluted, although fusion of the fibers certainly does not occur. Also, if it exceeds 13° C./min., fusion of the fibers disadvantageously takes place.

As the atmosphere at this time, oxygen, an oxygen-enriched air, air, etc. can be mentioned.

In the present invention, since a specific, optically isotropic pitch is used as a raw material for carbon fibers or activated carbon fibers, substantially no light components, which are a cause for fusion of the fibers during the course of infusibilization, is contained, and the infusibilization treatment can be carried out smoothly, even when the condition of a high heat-up rate ranging from 3°–13° C./min. is applied. Accordingly, the advantage that the fusion of yarns to each other is prevented and the infusibilization is carried out without applying an excessive infusibilization treatment can be attained.

(3) Production of Carbon Fibers by Carbonization

This is carried out according to a conventional process by heating the above-described infusibilized fibers in the presence of an inert gas, such as nitrogen, to 900° to 2000° C. for a certain period.

In this case, if necessary, the conditions of the treatment described above may be varied and further be graphitized.

(4) Production of Activated Carbon Fibers

According to a conventional process, the activation treatment of the above-described infusibilized fibers is carried out either after a slight carbonization of the fibers or directly.

Specifically, in the case where the slight carbonization is carried out, the carbonization is carried out according to a conventional process, for example, in an inert gas atmosphere, e.g., a nitrogen atmosphere, at a heat-up rate of 5°–100° C. up to 1000° C., preferably up to 800° C. The slight carbonization prior to the activation treatment makes it possible to activate the fibers which are in the state of various molded shapes, such as nonwoven fabrics, and textiles.

The activation is carried out according to a conventional process, for example, in a steam or carbon dioxide atmosphere at 600°–1500° C. for 10 minutes to 5 hours.

As the pitch for producing carbon fibers or activated carbon fibers having no trouble in the spinning and infusibilization stages, the use of an optically isotropic pitch which contains neither QI components nor optically anisotropic components is desired; however, under the present situation, such a pitch is difficult to be obtained in practice.

For example, a heavy oil or pitch having the primary QI components removed is thermally treated while air-blowing, whereby a pitch having a relatively high softening point and possessing good properties as spinning pitch (Japanese Patent Laid-Open Sho 61-28020) is attained. In spite of possessing a high softening point, it is difficult for this pitch to suppress the formation of optical anisotropic components, and generates fusion of spun fibers in infusibilization stage, and spinning nozzles are apt to be stained due to the high content of light components.

In order to improve this, there are techniques where a heavy oil or a pitch having the primary QI components removed being heat-treated while conducting the air-blowing under a reduced pressure to obtain an optically isotropic pitch (Japanese Patent Laid-Opens Sho 63-156886 and 63-156887) are suggested. These techniques have problems in that the load of the treatment under a reduced pressure is high, the yield of the resulting optically isotropic pitch is low, the cross-linked bonding of the pitch by air-blowing does not proceed, and optically anisotropic components tend to be formed.

In contrast, according to the present invention, by applying the two-stage heat treatment combining the heat treatment with air-blowing under normal pressure with the heat treatment with air-blowing under a reduced pressure, substantially no optically anisotropic components are formed, and light components can be sufficiently removed, whereby an optically isotropic pitch suitable as a raw material for carbon fibers or activated carbon fibers containing substantially no optically anisotropic component and having a low QI content can be obtained.

Moreover, even when the condition of a high heat-up rate of about 10° C./min. is applied in the course of infusibilization, the fusion of yarns to each other can be prevented, and the infusibilization can be carried out without applying an excessive infusibilization treatment, thereby significantly increasing the process's economy. Furthermore, since little damage of the fibers is inflicted due to infusibilization, the properties of carbon fibers or activated carbon fibers can be expected to be improved. Also, the stain of the nozzle due to light components, which is inevitably contained in the conventional pitch, can be prevented, so as to improve the spinning characteristics.

EXAMPLE

The present invention will now be described in greater detail by referring to the working examples; however, these examples are not intended to restrict the scope of the present invention.

Example 1

A heavy oil (initial fraction: 460° C., final fraction 560° C.; softening point: 72° C.) obtained by filtering a petroleum catalytic cracking heavy oil and removing the catalyst, followed by distillation was used as a raw material pitch. This was filled in a 200 L volume reactor in the amount of 140 kg, and heat-treated at 350° C. for 8 hours while air-blowing at an air feeding rate of 1.3 NL/kg.min. to obtain an intermediate optically isotropic pitch (softening point: 250° C.; QI=8.6% by weight) in the yield of 63.1% by weight.

When the pitch was observed with a polarization microscope, substantially no optically anisotropic pitch was found.

Subsequently, 2.0 kg of the intermediate optically isotropic pitch obtained as described above is filled in a 10 L volume reactor and heat-treated under a reduced pressure of 5.0 mmHg (667 Pa) at 350° C. for 0.5 hours, while air-blowing at an air blowing rate of 1NL/kg.min. to obtain an optically isotropic pitch (softening point 291° C.; QI=17% by weight) in the yield of 91% by weight.

When the pitch was observed with a polarization microscope, substantially no optically anisotropic component was found.

This pitch was spun from a nozzle having an inner diameter of 0.3 mm at a spinning temperature of 360° C. by melt blowing to produce 18–20 $\mu$ pitch fibers.

The resulting pitch fibers were further infusibilized in an air atmosphere with an initial temperature of 120° C. being heated up at a high heat-up rate of 10° C./min. to 320° C.

The yield of the resulting infusibilized fibers were 105.2% by weight, and there was no fusion of the fibers to each other.

Example 2 and 3

The same procedure as that of Example 1 was repeated, but the temperatures and periods of the first and second heat treatment of pitch were varied as shown in Table 1. The results are shown in Table 1 together with those of Example 1.

TABLE 1

| | First Heat Treatment | | | Second Heat Treatment | | |
|---|---|---|---|---|---|---|
| Example | Temp. (°C.) | Time (hrs) | QI Contents (%) | Temp. (°C.) | Time (hrs) | QI Contents (%) |
| 1 | 350 | 8 | 8.6 | 350 | 0.5 | 17 |
| 2 | 340 | 7 | 4.0 | 340 | 0.5 | 10 |
| 3 | 330 | 6 | 2.0 | 330 | 0.5 | 4.5 |

Comparative Example 1

The pitch (softening point 260° C.; QI=12% by weight) obtained by only carrying out the heat-treatment with air-blowing as with Example 1, for 10 hours was found to contain 7% of optically anisotropic components through the observation with a polarization microscope.

Due to frequent fusion of the fibers to each other, the infusibilized fibers obtained by spinning and infusibilizing the above pitch could not be put into practice.

In order to prevent the fusion between fibers, it is required to carry out a similar infusibilization to that of the above-mentioned more slowly, at a rate of not more than 0.5° C./min.

Comparative Example 2

When the heat treatment under a reduced pressure with air-blowing is carried out for 2 hours as that in Example 1 at the first time, the load of the treatment under a reduced pressure was too large resulting in a low yield of about 20% by weight.

The crosslinking and polymerization reaction due to the air blowing did not proceed sufficiently, and this pitch was found to have a high content, about 10%, of optically anisotropic components, and had poor spinning characteristics.

What is claimed is

1. A process for producing a pitch for a raw material for carbon fibers or activated carbon fibers, suitable for a raw material for carbon fibers or activated carbon fibers containing substantially no optically anisotropic component, having a QI content of 25% or less, and having a softening point of at least 260° C., which comprises:

(a) a first heat-treatment stage for heat-treating a pitch at a constant temperature and at about atmospheric pressure while blowing therein an oxygen-containing gas, and stopping said heat treatment just before optically anisotropic components are formed, to obtain an intermediate optically isotropic pitch having a QI content of 25% or less, and (b) a second heat-treatment stage for heat-treating the intermediate pitch under a reduced pressure of not more than 100 mmHg at a constant temperature while blowing therein an oxygen-containing gas to obtain an optically isotropic pitch having a softening point of at least 260° C.

2. The process according to claim 1, wherein the first heat-treatment stage (a) is carried out from atmospheric pressure to 0.3 kg/cm$^2$.G, at 300° to 370° C. for 5 to 12 hours, and the second heat-treatment stage (b) is carried out at a reduced pressure of not more than 100 mmHg at 300° to 370° C. for 10 minutes to 3 hours.

3. A process for producing pitch for a raw material for carbon fibers or activated carbon fibers containing substantially no optically anisotropic component, having a QI content of 25% or less, and having a softening point of at least 260° C., which comprises:

(a) a first heat-treatment stage for heat-treating a pitch at a constant temperature of 300° to 370° C. and at about atmosphere pressure while blowing therein an oxygen-containing gas, and stopping said heat treatment just before optically anisotropic components are formed, to obtain an intermediate optically isotropic pitch having a QI content of 25% or less, and (b) a second heat-treatment stage for heat-treating the intermediate pitch under a reduced pressure of not more than 100 mmHg at a constant temperature of 300° to 370° C. while blowing therein an oxygen-containing gas to obtain an optically isotropic pitch having a softening point of at least 260° C.

* * * * *